US006994809B1

(12) United States Patent
Prior

(10) Patent No.: US 6,994,809 B1
(45) Date of Patent: Feb. 7, 2006

(54) PLUG FOR AND METHOD OF PATCHING A HOLE IN A WALL

(76) Inventor: Walter H. Prior, 872 W. 16th St., Newport Beach, CA (US) 92663

( * ) Notice: Subject to any disclaimer, the term of this patent is extended or adjusted under 35 U.S.C. 154(b) by 0 days.

(21) Appl. No.: 10/390,112

(22) Filed: Mar. 17, 2003

Related U.S. Application Data

(63) Continuation of application No. 09/835,895, filed on Apr. 16, 2001, now abandoned.

(51) Int. Cl.
*B29C 73/06* (2006.01)

(52) U.S. Cl. ..... 264/36.2; 264/36.18; 264/35; 264/138; 264/154; 264/514; 264/514.5

(58) Field of Classification Search ..... 264/35, 264/36.18, 36.2, 138, 154; 52/514, 514.5
See application file for complete search history.

(56) References Cited

U.S. PATENT DOCUMENTS

| | | | | |
|---|---|---|---|---|
| 3,325,955 A | | 6/1967 | Haut | |
| 3,874,505 A | | 4/1975 | Mirarchi et al. | 206/223 |
| 4,062,165 A | | 12/1977 | Marks et al. | 52/514 |
| 4,260,575 A | * | 4/1981 | Thew et al. | 264/154 |
| 4,311,656 A | | 1/1982 | Spriggs | 264/36 |
| 4,715,151 A | | 12/1987 | Garblik | 52/2 |
| 4,776,906 A | * | 10/1988 | Bernard | 156/85 |
| 4,930,281 A | | 6/1990 | Martin et al. | 52/514 |
| 4,989,385 A | | 2/1991 | McCullough | 52/514 |
| 5,353,568 A | | 10/1994 | Silva | 52/514 |
| 5,555,691 A | | 9/1996 | Nguyen | 52/514 |
| 5,925,204 A | | 7/1999 | Hoffmann, Sr. | 156/98 |
| 6,378,263 B1 | | 4/2002 | Sobers | 52/514 |
| 6,607,621 B1 | * | 8/2003 | Swanson | 156/94 |

* cited by examiner

*Primary Examiner*—Michael P. Colaianni
(74) *Attorney, Agent, or Firm*—James G. O'Neill; Klein, O'Neill & Singh, LLP

(57) ABSTRACT

A hole in a wall is easily and quickly repaired by use of a precisely formed plug. The plug is used to draw an outline around the hole. The outline is then cut out to form an opening. The plug is inserted into the opening until a rear surface of the plug loosely contacts a parallel inner wall and an outer surface of the plug is slightly misaligned or moved inwardly from a front surface of the wall. The misaligned outer surface of the plug and the opening are then covered or plastered over.

7 Claims, 2 Drawing Sheets

PLUG FOR AND METHOD OF PATCHING A HOLE IN A WALL

CROSS REFERENCE TO RELATED APPLICATIONS

This is a continuation of application Ser. No. 09/835,895, filed Apr. 16, 2001, ABN.

BACKGROUND OF THE INVENTION

1. Field of the Invention

This invention relates generally to wall repair and, more particularly, to a precise plug for and improved and simplified method of repairing a damaged wall.

2. Description of Related Art

As is well known, if a door or other object is banged or slammed into a wall, particularly one made out of sheet rock, an ugly depression or hole will be made. To repair such depressions or holes, depending on their size, persons try to use plaster, and if the holes are large, also use some type of netting or sheeting in an attempt to hold the plaster in place. The patched or repaired hole must then be sanded and painted, and if too rough, causes many further problems.

However, the known methods and products for repairing holes in walls do not always produce acceptable or attractive results. Examples of such known methods and products are set forth in U.S. Pat. No. 3,325,955 to Haut, U.S. Pat. No. 3,874,505 to Mirarachi et al., U.S. Pat. No. 4,062,165 to Marks et al., U.S. Pat. No. 4,311,656 to Spriggs, U.S. Pat. No. 4,715,151 to Garblik, U.S. Pat. No. 4,930,281 to martin et al., U.S. Pat. No. 4,989,385 to McCullough, U.S. Pat. No. 5,353,568 to Silva, U.S. Pat. No. 5,555,691 to Nguyen, U.S. Pat. No. 5,925,204 to Hoffmann, Jr. and U.S. Pat. No. 6,378,263 to Sobers.

These known methods and products require special tools and/or equipment, tend to be complicated or expensive, and are not easily used by all persons. Therefore, there exists a need in the art for an improved precise product and easy to use method for repairing holes in walls in an acceptable and attractive manner.

SUMMARY OF THE INVENTION

It is, therefore, a general object of the present invention to provide an improved and simplified method of repairing walls. It is a particular object of the present invention to provide an improved method to more easily, quickly and smoothly patch a hole in a wall. It is another particular object of the present invention to provide an improved precise plug for use in patching holes in walls. It is yet another particular object of the present invention to provide an improved method of patching holes in walls that enables a person to easily and quickly provide a smooth patch. And, it is still another particular object of the present invention to provide an improved method that allows a person to quickly cut out a portion of a wall, insert a precisely cut plug and plaster over the precisely cut plug and any remaining opening.

These and other objects and advantages of the present invention are achieved by providing a precisely cut plug that is used to outline an area, trimming around the area, inserting the precisely cut plug in the trimmed out area and plastering over the precisely cut plug to provide an attractive repair.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DETAILED DESCRIPTION OF THE PREFERRED EMBODIMENTS

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein, specifically to provide for an improved and simplified method and article for use in easily and quickly repairing a hole in a wall.

Basically, the present invention incorporates a precisely cut block or plug of material that is used to form an outline for an opening in a wall, cutting the opening and placing the precisely cut block in the opening made in the wall and then applying plaster over the end of the precisely cut plug and the opening. The plastered hole is then sandpapered smooth and painted to provide an attractive repair.

Turning now to the drawings, FIGS. 1–4 illustrate the preferred method using a precisely cut block or plug of material 10 (see FIGS. 3 and 4), preferably made from a lightweight plastic or foam material, such as Styrofoam, or the like. The precisely cut plug 10 may be any desired size, but is preferably rectangular, as shown. The precisely cut plug 10 is preferably die-cut or otherwise formed to exact measurements. In a currently preferred embodiment of the plug 10 it is precisely die-cut to form a block that is a 3⅞" cube, i.e., the plug is precisely 3⅞" along each edge or side so as to exactly fit between parallel walls in known wall systems.

Figure 1:
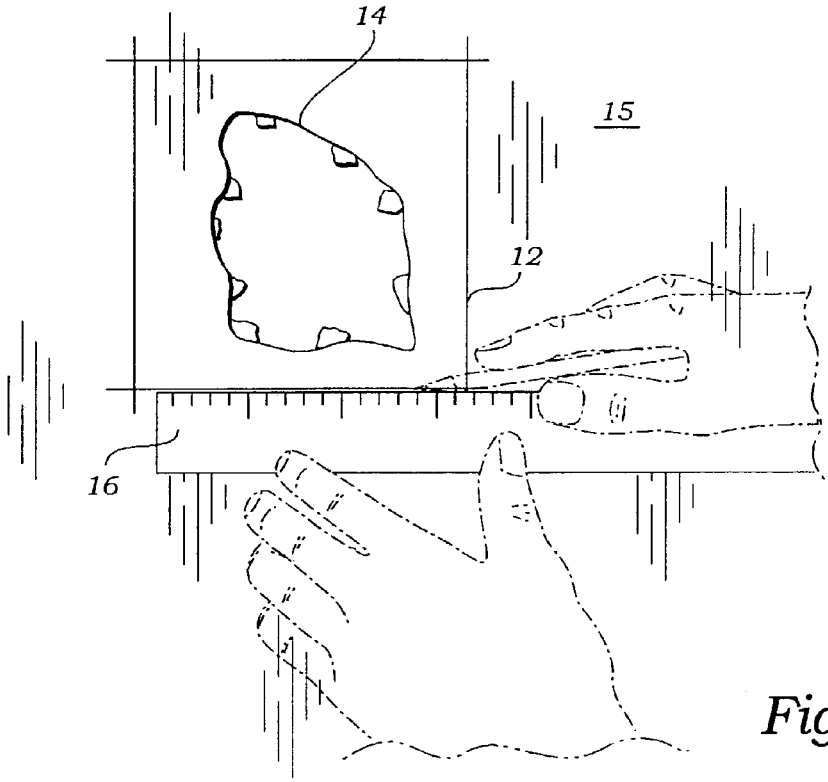
FIG. 1 is a front elevational view showing a person forming an outline around a hole in a wall using a precisely cut plug.

As shown in FIG. 1, one side of the precisely die-cut block 10 is used to draw an outline 12 on an outer surface of a wall 15, around a hole 14 that is to be repaired. Although usually not needed, the outline 12 may be straightened or darkened by using a ruler or other straight edge 16.

Figure 2:
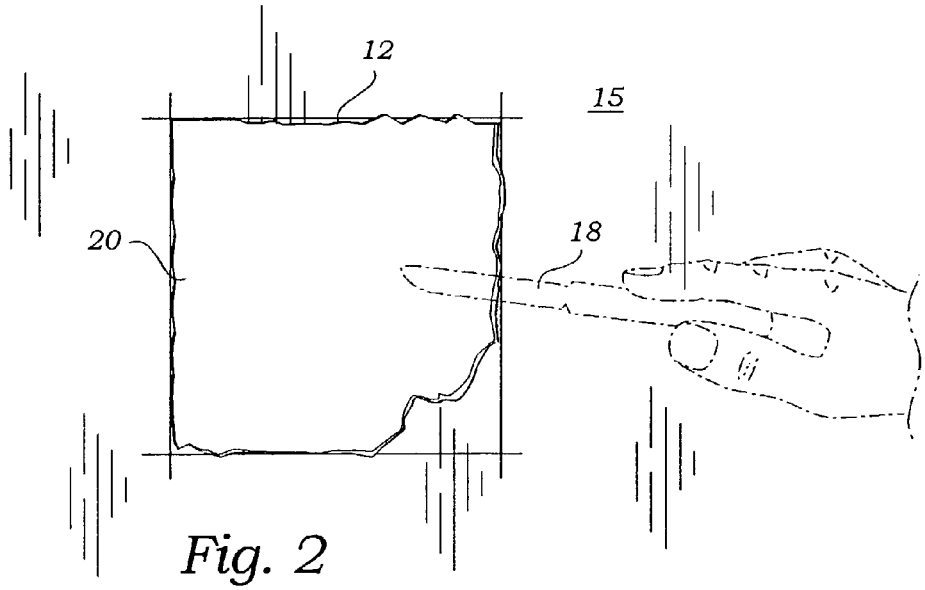
FIG. 2 is a front elevational view of a person cutting out the outlined portion of FIG. 1.
Figure 3:
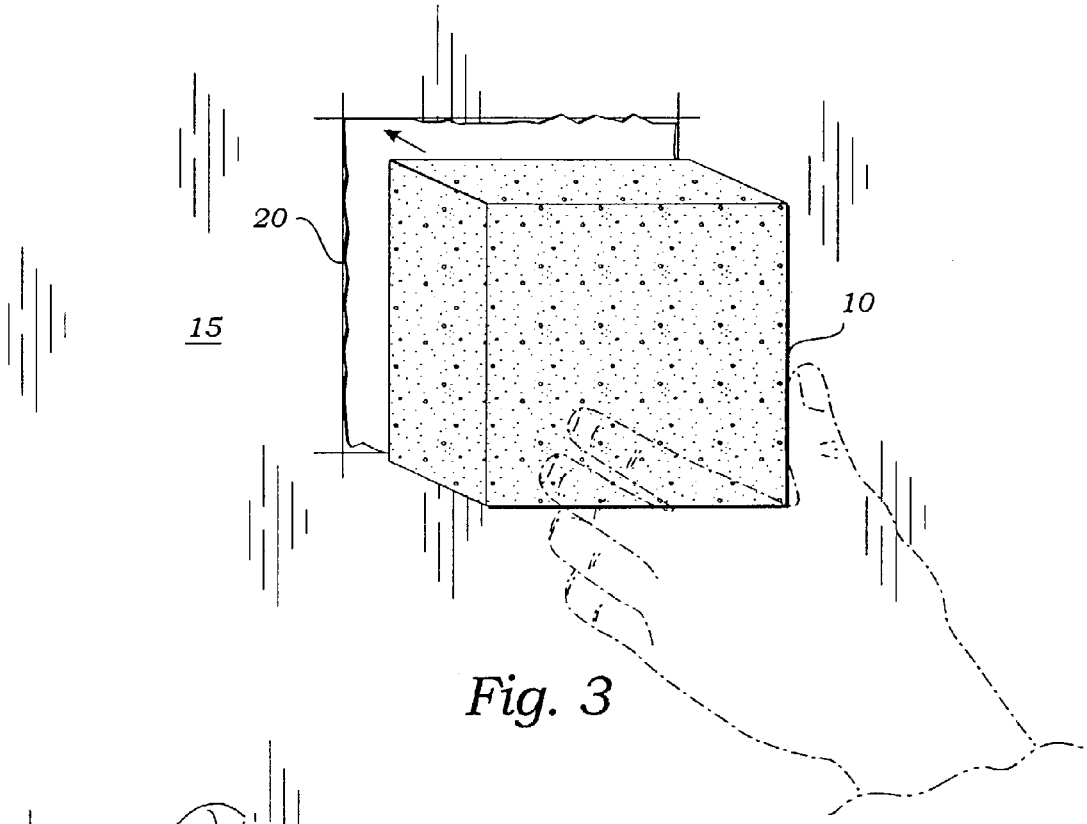
FIG. 3 is a perspective view of the precisely cut plug being inserted in the cut-out hole.

As illustrated in FIG. 2, the outlined area 12 is then cut or trimmed out, as by use of a knife, or the like 18, until a substantially rectangular or square opening 20 is formed. Preferably the opening 20 is sized and dimensioned to easily accept and snugly hold the precisely cut block 10, without requiring any further guide or holding means for the plug.

The die-cut rectangular plug 10 is then easily inserted directly into the opening 20 (see FIG. 3), until a back surface of the plug loosely contacts or rests against an inner parallel wall, not shown, without the need of a guide to insert the plug, or an adhesive or other holding means to hold or support the plug in this position. The front surface of the precisely cut block 10 is misaligned with or slightly indented from the outer surface of the wall 15 (approximately ⅛"). That is, a slight indentation is formed when the plug 10 is in the opening 20. The precisely cut plug 10 is retained in place in the opening 20 (see FIG. 4) and against the parallel inner wall without the need of any adhesive or other holding means, and cannot (or should not) fall into the space behind wall 15 and the inner wall.

Figure 4:
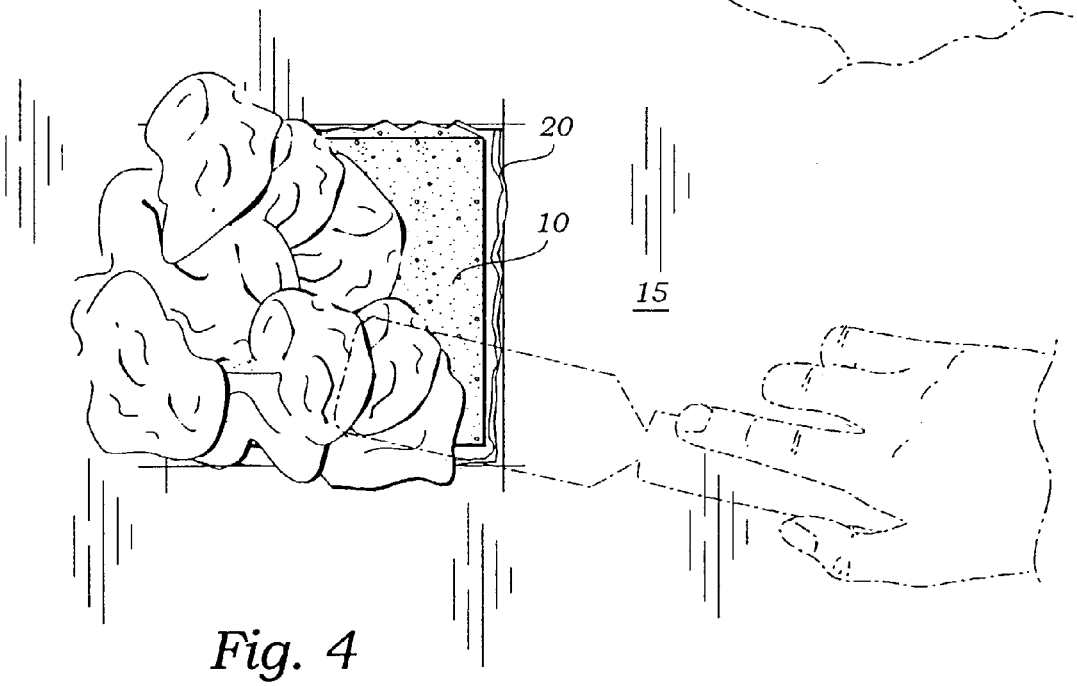
FIG. 4 is a front elevational view of the cut-out hole with the precisely cut plug held therein, and a person plastering over the precisely cut plug.

As shown in FIG. 4, with the precisely cut plug 10 held in the opening 20, and the front face of the plug moved in from or misaligned with the front surface of wall 15, the opening 20 and the indentation formed by the misaligned front face of the plug are plastered or otherwise covered or filled. The material covering, filling or plastered over opening 20 and the misaligned front face of the plug 10 may then sandpapered to the desired smoothness, and the smooth surface painted to match the remainder of the front surface of the wall 15, in an attractive and expeditious manner.

It, therefore, can be seen that the method and precise die-cut plug of the present invention allow a hole in a wall to be easily, quickly and smoothly repaired in a minimum period of time, with a minimum of effort. Additionally, the repair made will provide a more attractive appearance.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A method for repairing a hole in a wall consisting of the steps of:

forming a precisely-shaped cube from a foam material to be used as a plug;

placing a surface of the precisely-shaped cube over the hole to be repaired and drawing around the precisely-shaped cube to form an outline around the hole to be repaired;

cutting out a rectangular opening through the wall using the outline as a form;

inserting the precisely-shaped cube into the rectangular opening until a rear face of the precisely-shaped cube loosely rests against an inner wall and an opposed face of the precisely-shaped cube is firmly held in the rectangular opening; and plastering over the opposed face of the precisely-shaped cube held in the rectangular opening to repair the hole.

2. The method of claim 1 wherein the precisely-shaped cube is exactly 3⅞" on a side.

3. The method of claim 2 wherein an indented surface formed by the opposed surface of the precisely-shaped cube in the rectangular opening is plastered over, sandpapered smooth and then painted.

4. The method of claim 1 wherein an indented surface formed by the opposed surface of the precisely-shaped cube held in the rectangular opening is plastered over, sandpapered smooth and painted to match the wall.

5. The method of claim 4 wherein the precisely-shaped cube is exactly 3⅞" on a side.

6. A method for repairing a hole in a wall, consisting of the steps of:

forming a precisely die-cut cube that is exactly 3⅞" on a each side to be used as a plug;

using the precisely die-cut cube to draw an outline on a front surface of a wall around a hole to be repaired;

cutting along the outline to form a rectangular opening in the wall to be repaired;

inserting the precisely die-cut cube into the rectangular opening until a rear face loosely rests against a surface of an inner wall and a front face of the precisely die-cut cube is firmly held in the rectangular opening, slightly misaligned from the front surface of the wall; and covering the misaligned front face of the precisely die-cut cube held in the rectangular opening with a covering material.

7. The method of claim 6 wherein a surface formed by the covered misaligned front face of the precisely die-cut cube in the rectangular opening is sandpapered smooth and then painted to match a wall.

* * * * *